US006016588A

United States Patent [19]

Kamerschen

[11] Patent Number: 6,016,588

[45] Date of Patent: Jan. 25, 2000

[54] COMBINATION DOOR CATCH AND STOP

[76] Inventor: Keith C. Kamerschen, 28910 Fernwood, Inkster, Mich. 48141

[21] Appl. No.: 09/118,623

[22] Filed: Jul. 17, 1998

[51] Int. Cl.[7] ..... E05F 5/02

[52] U.S. Cl. ..... 16/82; 16/85

[58] Field of Search ..... 16/82, 85, 86 R, 16/86 A, 86 B; 292/DIG. 19, DIG. 17

[56] References Cited

U.S. PATENT DOCUMENTS

| | | | |
|---|---|---|---|
| 89,819 | 5/1869 | Wagner | 16/85 |
| 1,119,346 | 12/1914 | Concie et al. | 16/85 |
| 1,280,048 | 9/1918 | Lavender | 292/DIG. 19 |
| 4,134,608 | 1/1993 | Pool | 16/82 |
| 5,226,201 | 7/1993 | Lefebvre | 16/82 |
| 5,689,853 | 11/1997 | Lemmer | 16/82 |

*Primary Examiner*—Chuck Y. Mah
*Attorney, Agent, or Firm*—John R. Benefiel

[57] ABSTRACT

A door catch and stop comprised of a one piece plastic molded elongated member having a mounting portion at one end and main portion at the other end connected by an hour glass portion acting as a spring to allow the main portion to be deflected aside by a door edge engaging a cam surface formed thereon. A wide notch formed into the top of the main portion captures the door as the main portion restraightening when the door edge moves into the notch.

8 Claims, 2 Drawing Sheets

COMBINATION DOOR CATCH AND STOP

BACKGROUND OF THE INVENTION

The present invention concerns door stops and door catches. Such devices have long been known in the art. Combination door stops and catches have also long been known, as for example those shown in U.S. Pat. Nos. 947,865 and 1,042,340.

These devices heretofore known have been bulky, complex mechanisms relying on springs and hinges, etc, to operate notched catch members so as to stop a door after being swung open, and capture the same, holding the door in the open position.

It is the object of the present invention to provide a combination door stop and catch of the general type previously known, but of a simpler lower cost construction, and having a more pleasing trim appearance, more in keeping with modern interior decor.

SUMMARY OF THE INVENTION

The above recited object as well as others which will becomes apparent upon a reading of the following specification and claims are achieved by an elongated one piece molded plastic catch-stop member having a tapering hour glass shape portion adjacent a mounting portion at one end, and a notched main portion at the opposite end. The tip of the main portion is rounded and extends onto a curved cam surface producing a cam action when engaged by the edge of an opening door, the member mounted to project towards the location through which the door edge swings when opened. The hour glass shaped portion functions as an integral spring, allowing the member to resiliently deflect to one side as the member is cammed into a slightly bent shape allowing the door edge to pass by the leading end of the catch-stop member. The door edge moves into the notch and the main portion restraightens to snap back into position to capture the door. A higher rear wall defines the notch to abut the door rear surface and act as a stop. The lower rear wall is positioned to engage the opposite door surface and after restraightening thereby capture the door.

The simplicity of the device produces a low cost yet aesthetically appealing design, very well suited to modern interior decor.

DESCRIPTION OF THE DRAWING FIGURES

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
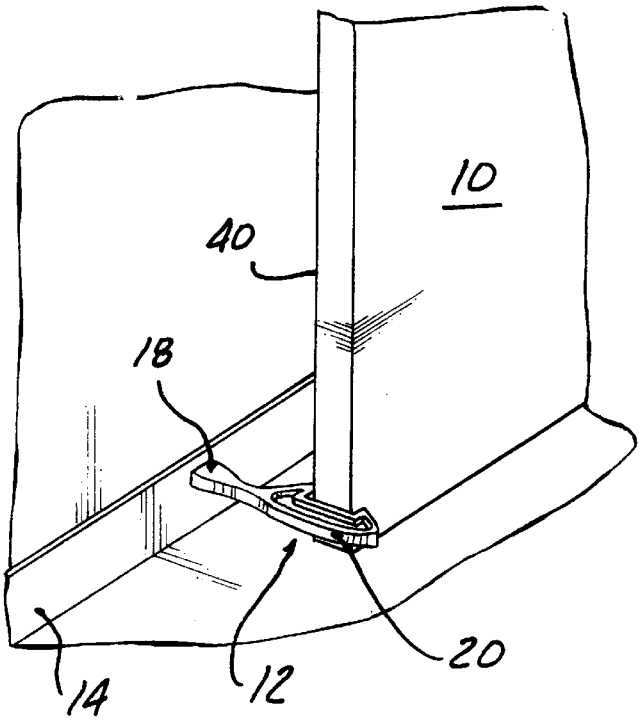
FIG. 1 is a fragmentary perspective view of a door installation and a combination catch and stop door according to the present invention.
Figure 2:
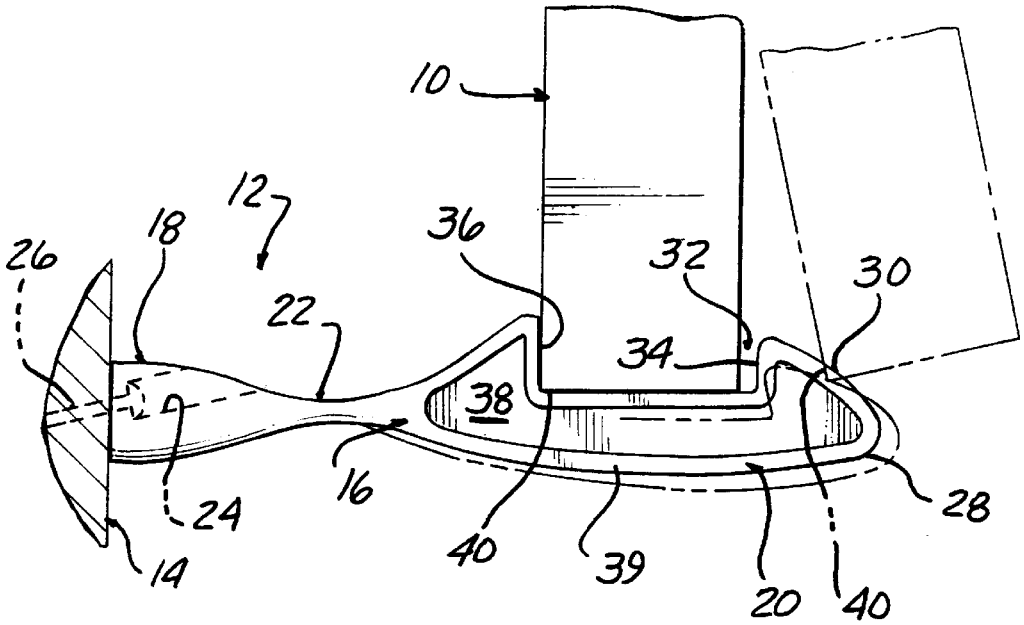
FIG. 2 is an enlarged plan view of the door catch and stop shown in FIG. 1 with a fragmentary portions of a mounting structure and door, the door portion shown in phantom lines in an approach position.
Figure 5:
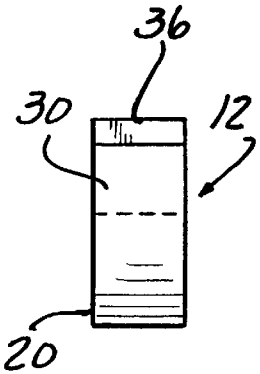
FIG. 5 is front end view of the door catch and stop shown in FIGS. 1–3.
Figure 3:
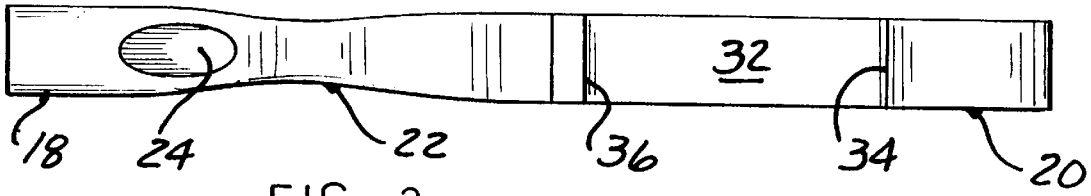
FIG. 3 is a top view of the door catch and stop shown in FIGS. 1 and 2.
Figure 4:
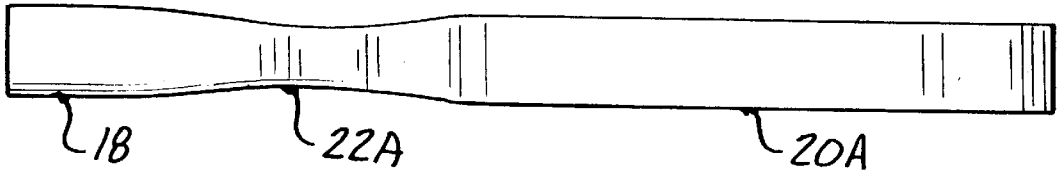
FIG. 4 is a bottom view of the door catch and stop shown in FIGS. 1–3.
Figure 6:
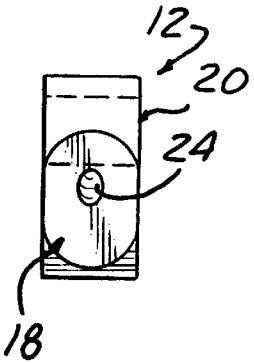
FIG. 6 is a rear end view of the door catch and stop shown in FIGS. 1–3.

Referring to the drawings, FIGS. 1–6 show a door 10 swung to the open position where it is stopped and captured by a combination door catch and stop 12 according to the present invention, here shown mounted to an adjacent wall baseboard 14. Other installations are also possible, such as at the top or bottom of the door.

The door catch and stop 12 is comprised of a one piece elongated member 16, preferably molded of a durable, resiliently deformable, plastic such as polypropylene or polyethylene, mounted to project outwardly from the baseboard 14.

The member 16 includes a mounting portion 18 at one end and a main catch-stop portion 20 at the other end, joined by an hour glass shaped spring section 22.

The mounting portion 18 has an angled rearwardly extending counterbored hole 24 formed therein to receive a mounting screw 26 advanced into the base board 14.

The main portion 20 has a rounded tip 28 margin, with a gradually curving camming surface 30 on the top side thereof, leading to a wide notch 32 defined by a forward vertical side 34 and a higher rear side 36.

A relief cavity 38 may be provided on each side to reduce the quantity of plastic required to mold the port, leaving a full width perimeter edge 39.

The stop 12 is mounted at a location such that as the door leading side edge 40 swings open, it engages the cam surface 30, causing the main portion 20 to be deflected away from the door 14, the hour glass shaped portion 22 bending to produce this deflection.

The door 14 thus enters the notch 32 and moves into abutment with rear wall 36, being stopped thereby. As the member restraightens when the hourglass portion 22 returns to its normal shape after the door 14 enters the notch 32.

To release, the main portion 20 is merely deflected as with the toe of one foot, to allow the door to be released.

The edges of the member 16 are all rounded and the "stretched fish" shape produces a trim pleasing appearance.

The one piece construction of molded plastic allows manufacture at a very low price.

I claim:

1. A door catch and stop, for stopping and capturing a door edge located to swing open into said door catch and stop, comprising:

an elongated one piece member, formed of a resilient material, having a mounting portion at one end and a main portion at an opposite end, said portions connected together by a reduced cross sectional area hour glass shaped section;

a wide notch formed into one side of said main portion, of a size able to receive and accommodate a door edge;

a curved cam surface extending back from a tip of said main portion defining said opposite end, said cam surface located to be engaged by said door edge as said door is swung open and deflecting said main portion away by bending of said hour glass section as said door continues to swing open;

said cam surface extending to said wide notch whereby said door edge enters and is captured by said notch as said member is straightened by the resilience of said hour glass shaped section.

2. The door catch and stop according to claim 1 wherein said member is of molded plastic.

3. The door catch and stop according to claim 1 wherein said main portion of said member is of a slender curved shape.

4. The door catch and stop, according to claim 1 wherein said mounting portion has an angled hole formed therein extending rearwardly and out through a rear face of said mounting portion.

5. The door catch and stop according to claim 1 wherein main portion has opposite sides and a surface cavity is formed into each side of said main portion leaving a full-width perimeter edge.

6. The door catch and stop according to claim 1 wherein said notch is formed by spaced apart forward and rear sides extending in from an upper perimeter of said main portion.

7. The door catch and stop according to claim 6 wherein said rear notch side is higher than said forward side to act as a stop for said door.

8. The door catch and stop according to claim 1 wherein said member has a curved edge on a side thereof opposite said cam surface extending to blend into said hour glass section, said mounting portion having opposite curved sides blending into said hour glass section to thereby produce a stretched fish shape of said member.

* * * * *